US005699043A

United States Patent [19]

Vane et al.

[11] Patent Number: 5,699,043

[45] Date of Patent: *Dec. 16, 1997

[54] INDIVIDUAL SMOKE DETECTOR WITH SENSITIVITY CALIBRATION AND MONITORING

[75] Inventors: Burton Warner Vane, Fairport; David Bush Lederer, Sodus Point, both of N.Y.

[73] Assignee: Detection Systems, Inc., Fairport, N.Y.

[ * ] Notice: The term of this patent shall not extend beyond the expiration date of Pat. No. 5,543,777.

[21] Appl. No.: 692,888

[22] Filed: Aug. 1, 1996

Related U.S. Application Data

[63] Continuation of Ser. No. 89,540, Jul. 12, 1993, Pat. No. 5,543,777.

[51] Int. Cl.[6] ..... G08B 29/00

[52] U.S. Cl. ..... 340/514; 340/630

[58] Field of Search ..... 340/514, 630, 340/628, 516, 540, 556; 250/573, 574, 577

[56] References Cited

U.S. PATENT DOCUMENTS

| | | | |
|---|---|---|---|
| 4,302,753 | 11/1981 | Conforti | 340/628 |
| 4,317,113 | 2/1982 | Honma | 340/630 |
| 4,559,453 | 12/1985 | Muggli et al. | 340/630 |
| 4,595,914 | 6/1986 | Siegel | 340/516 |
| 4,977,527 | 12/1990 | Shaw et al. | 340/630 |
| 5,212,470 | 5/1993 | Thuillard et al. | 340/630 |
| 5,243,330 | 9/1993 | Thuillard | 340/629 |
| 5,281,810 | 1/1994 | Fooks et al. | 340/556 |
| 5,543,777 | 8/1996 | Vane et al. | 340/514 |
| 5,546,074 | 8/1996 | Bernal et al. | 340/628 |

*Primary Examiner*—Jeffery Hofsass
*Assistant Examiner*—Daryl C. Pope
*Attorney, Agent, or Firm*—J. Addison Mathews

[57] ABSTRACT

A process and apparatus are provided for calibrating an individual smoke detector prior to installation so its sensitivity can be determined easily throughout its useful life. Representations of detector output signals are stored in the detector prior to installation, preferably at the time of manufacture, and used later for determining the sensitivity of the detector. The signals may represent alarm and clean-ambient conditions, or one of such conditions and the difference between them. During monitoring of the detector, after its installation, a new reading of a corresponding signal under clean-ambient conditions is sampled and the differences before and after installation are compared to determine the sensitivity of the detector when it is monitored. The detector includes electrical contacts from which a representation of detector sensitivity is available for monitoring with an external electrical probe, such as a common voltmeter.

16 Claims, 4 Drawing Sheets

FIG. 1
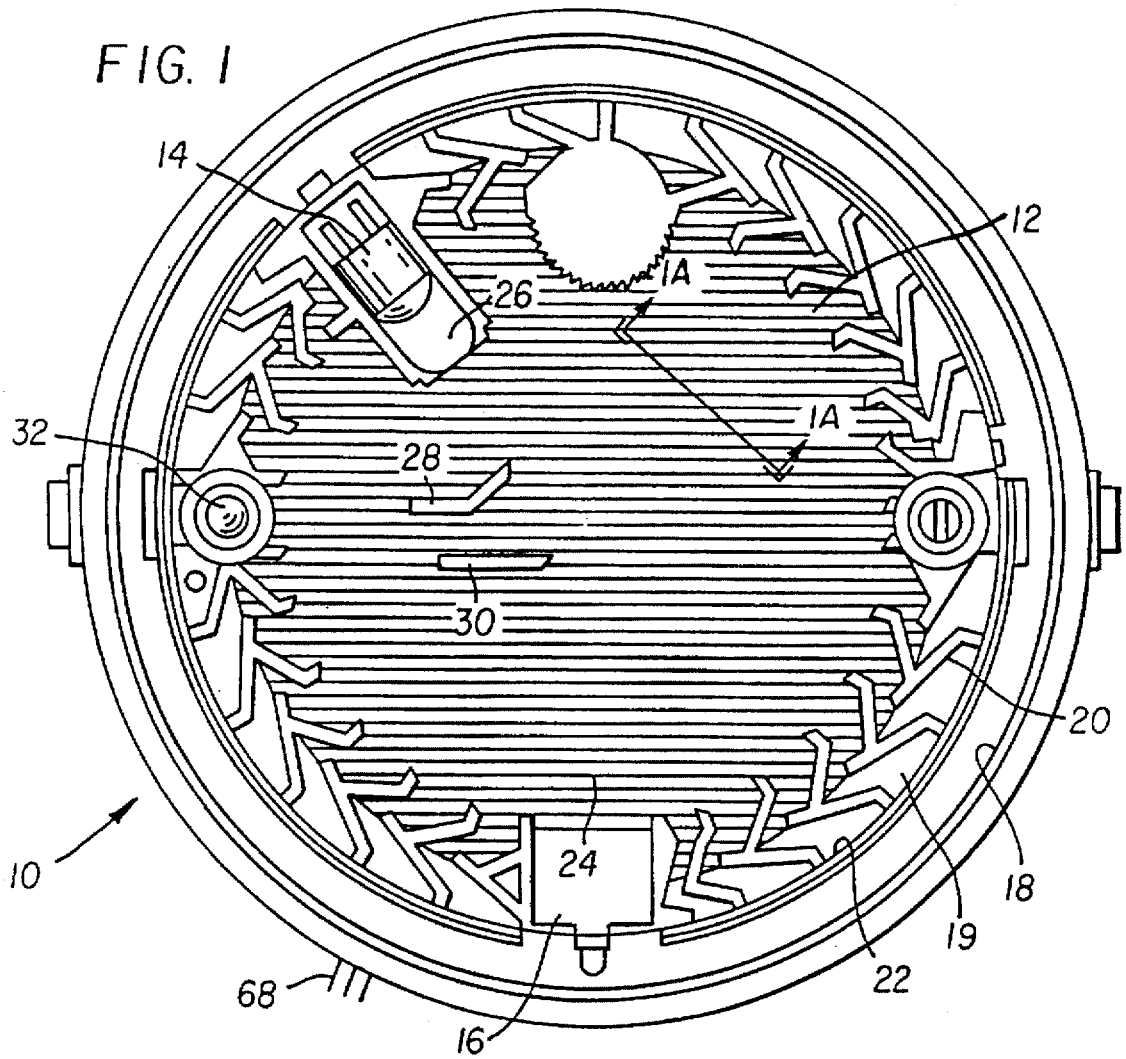
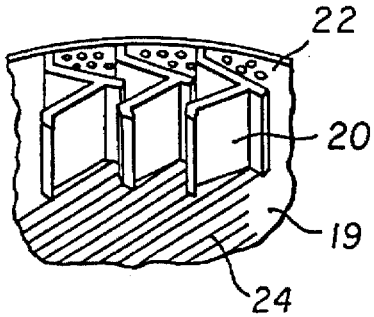
FIG. 1A

INDIVIDUAL SMOKE DETECTOR WITH SENSITIVITY CALIBRATION AND MONITORING

CROSS-REFERENCE TO RELATED APPLICATIONS

This is a continuation of our commonly assigned, application Ser. No. 08/089,540, filed Jul. 12, 1993, now U.S. Pat. No. 5,543,777.

Reference is made to commonly assigned copending U.S. patent application Ser. No. 08/089,539, entitled SMOKE DETECTOR CALIBRATION AND TEST, filed on even date herewith in the names of Burton W. Vane and David B. Lederer. The disclosed subject matter of this cross-referenced application hereby is incorporated by reference into the present application.

BACKGROUND OF THE INVENTION

1. Field of Invention

The invention relates to smoke detection, and more specifically to a method and apparatus for calibrating a smoke detector prior to installation and for monitoring the sensitivity of the detector after installation and use.

2. Description of the Prior Art

Prior art smoke detectors typically include a dark chamber through which airborne particles of smoke are free to circulate. A source of light, such as an infrared emitter, directs illumination along a defined path extending into the chamber. A photoelectric sensor is positioned out of the path of direct illumination, but is aimed to view the chamber and illumination scattered or reflected from the path by circulating level of scattered or reflected illumination above a predetermined threshold, it issues an alarm signal.

Smoke detectors may be calibrated prior to installation and monitored for proper performance throughout their useful life. During calibration, an atmosphere representing a predetermined level of obscuration, such as three percent per foot, may be injected into the chamber and the smoke detector adjusted to alarm at the resulting signal level. The calibration level is chosen to represent the conditions that would exist when a fire is in its early stages of development.

Monitoring the detector after installation is somewhat more difficult, because its location may not be conducive to testing with a calibration sample. Frequently the detector must be removed from its location so it can be tested in a manor similar to that used prior to installation. Still, a satisfactory solution is not so simple. Detectors accumulate dust and other reflecting material in their chambers over time. The dust reduces the amount of obscuration required to activate an alarm, increasing the sensitivity of the detector and its tendency toward false alarms. Although the detector may have an extended period of useful life, its sensitivity and remaining life are difficult to determine with calibration samples.

Still other problems occur with opposite effects. A bug or other foreign matter may partially block the source of illumination, decreasing the sensitivity of the detector and its ability for early warning.

Statistical sampling has been employed to estimate changes in detector performance. Many variables are involved, however, because the characteristics of the individual detector are seldom retained after installation. Each detector is different from other detectors in the same family, and, of course, the conditions of installation vary greatly. As noted above, some effects tend to increase sensitivity while others reduce sensitivity, and, although not entirely random, historical changes are very difficult to predict.

SUMMARY OF THE INVENTION

The present invention is directed to overcoming one or more of the problems set forth above in a smoke detector suitable for installation in existing two and four-wire systems. Briefly summarized, according to one aspect of the invention, a process and apparatus are provided for calibrating an individual smoke detector prior to installation so its sensitivity can be determined easily throughout its useful life. Representations of detector output signals are stored in the detector prior to installation, preferably at the time of manufacture, and used later for determining the sensitivity of the detector. The signals may represent alarm and clean-ambient conditions, or one of such conditions and the difference between them. During monitoring of the detector, after its installation, a new reading of a corresponding signal under ambient conditions is sampled and the differences before and after installation are compared to determine the sensitivity of the detector at the time when it is monitored.

According to more specific features of the invention, the detector includes electrical contacts from which a representation of detector sensitivity is available for monitoring with an external electrical probe, such as a common voltmeter.

Each smoke detector can be calibrated on an individual basis and the calibration information retained in the detector wherever it goes after installation. The sensitivity can be measured electrically without the need for calibrated obscuration samples, and the measured sensitivity reflects the actual sensitivity of the detector, not merely its pass or fail condition. The detector is suitable for use in existing two and four wire systems, and does not require the complexity of multiplexing, where each detector has a unique identification recognized by a central control.

These and other features and advantages of the invention will be more clearly understood and appreciated from the following detailed description of the preferred embodiment and appended claims, and by reference to the accompanying drawings.

BRIEF DESCRIPTION OF THE DRAWINGS

FIG. 1 is a top plan view of a smoke detector with the top removed, including an infrared emitter and optical sensor on opposite sides of a dark chamber.

FIG. 1A is a partial perspective view taken from section 1A—1A in FIG. 1, showing more detail of the peripheral structure thereof.

DESCRIPTION OF THE PREFERRED EMBODIMENTS

Figure 2:
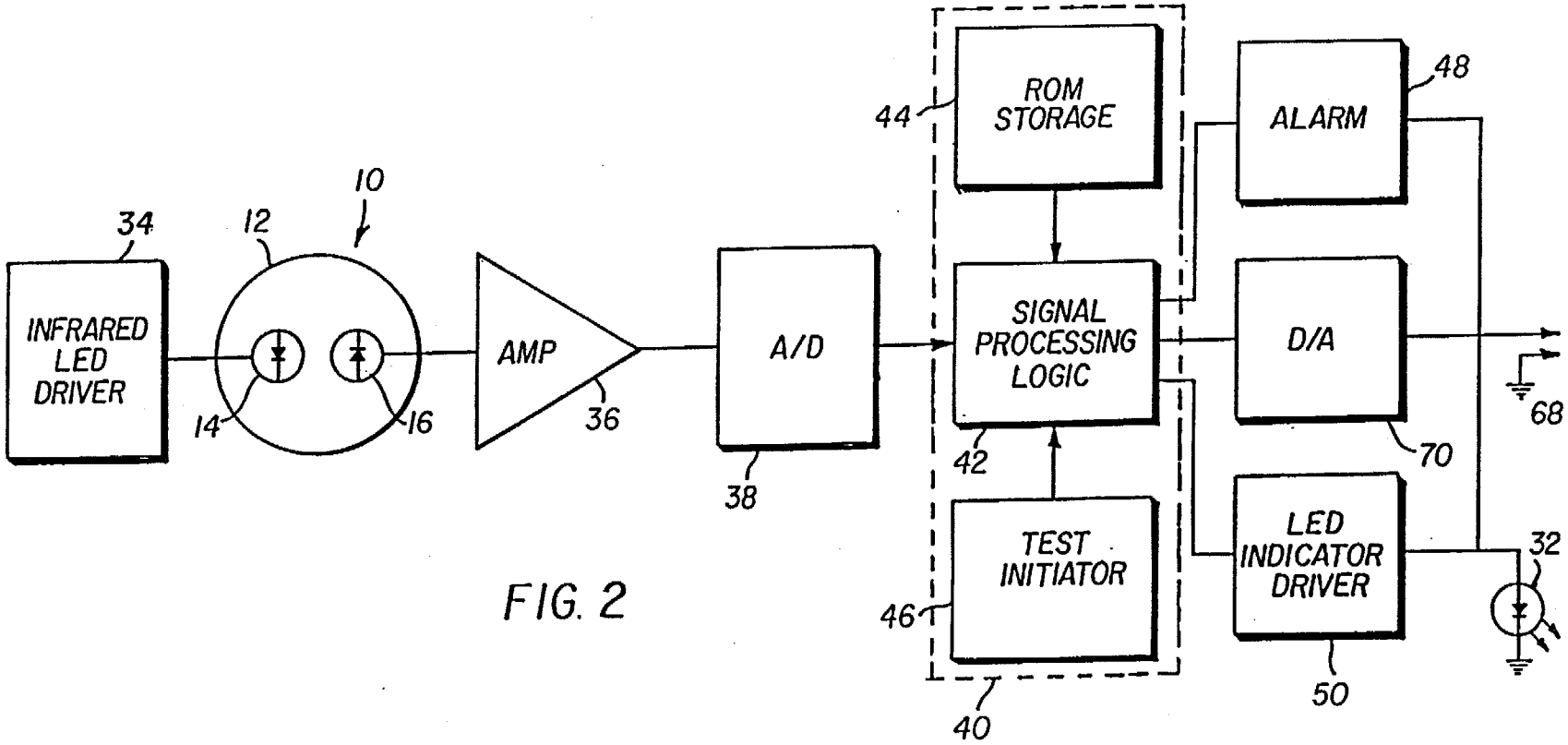
FIG. 2 is a block diagram representing electrical elements and circuits included in the detector of FIGS. 1 and 1A for storing and using calibration information in accordance with the invention.

Referring now to FIGS. 1 and 1A, a preferred embodiment of a smoke detector 10 is depicted in accordance with the present invention, including a dark chamber 12 containing an infrared emitter 14 and an optical sensor 16 in the form of a photo detector sensitive to the infrared wavelengths of the emitter.

The chamber 12 is defined by a hollow base 18 and cap (not shown) including floor 19 and cover sections separated by a peripheral wall 20 of overlapping bent fingers. The fingers define a tortuous path for blocking external ambient light from the chamber with minimal interference to the circulation of air and smoke. A fine-mesh screen 22 surrounds the periphery of the chamber around the fingers and is sandwiched between the floor and cover to block insects and large dust particles from the chamber. The mesh size is chosen to provide minimal resistance to the passage of smoke particles, particularly those particles of a size and type generated by a fire during its early stages of development. The interior surfaces of the chamber are black and shaped to reflect any incident light away from the optical sensor 16. The floor and cover include reticulated surfaces 24, for example, to minimize reflections within the chamber.

The emitter 14 and optical sensor 16 are positioned on opposite sides of the chamber, at an angle of approximately 140 degrees, to optimize the response of the detector to a variety of typical smoke particles. The emitter is a light emitting diode (LED), operating in the infrared, which directs a beam or spot of illumination across the chamber. The spot is confined by apertures 26 defined by mating surfaces of the floor and cover. Upstanding baffles 28 and 30 provide a dual septum that blocks the optical sensor from directly viewing the emitter and further confines the beam to its desired path. The optical sensor 16 includes a photo diode mounted out of the path of direct illumination, but aimed to view the chamber and any illumination scattered or reflected from the path by circulating particles, such as smoke. Although not apparent from the drawings, the photo diode actually is below the chamber and light is reflected to it by a prism and focused on it by a lens.

Under clean-ambient conditions, the background scatter, or level of light reflected by the chamber into the sensing element 16, is low. When airborne smoke enters the chamber, the amount of light reflected out of the illumination path and into the optical sensor increases. The electrical output of the optical sensor is proportional to the reflected light entering the sensor, and when the resulting signal exceeds a predetermined threshold, an alarm is activated. The alarm may include visual or audible warnings issued from the alarm itself or from external generators associated with the alarm typically through a control panel. One such warning device illustrated in FIG. 1 is a light emitting diode (LED) 32, operating in visible wavelengths. This same LED also serves a number of other functions that will be described hereinafter.

Referring now to FIG. 2, the infrared emitter 14 is pulsed on for one hundred and fifty microseconds (150 μsec.) every seven seconds (7 sec.) by a temperature compensated current driver 34. The output of the optical sensor 16 is amplified by an operational amplifier 36, configured as a DC coupled current amplifier. The amplified signal is converted from an analog to a digital representation of the sensor output by a sample and hold circuit and analog-to-digital (A/D) converter 38.

Operation of the smoke detector is controlled by a micro controller 40 including signal processing logic 42, write once and Read Only Memory (ROM) 44 and test initiator 46. It is the micro controller that controls the timing of the emitter pulses. The micro controller also coordinates sampling of the sensor output signal in accordance with a sequence properly coordinated with the emitter.

Prior to installation of the smoke detector, preferably during its manufacture, each detector is calibrated on an individual basis and the resulting calibration factors are stored by the micro controller 40 in ROM 44 for later use.

A first calibration factor represents an alarm condition, and is determined by circulating through chamber 12 a gaseous or aerosol calibration medium. The circulation medium represents the lowest percent obscuration per foot that should cause the detector to issue an alarm. When the medium enters the chamber, it reflects infrared energy out of the illumination path from emitter 14 where it is viewed by optical sensor 16. The output signal that results from the test is measured and stored for use by the detector during operation after installation.

A second calibration factor represents a corresponding output signal under clean-ambient conditions. This signal is measured without obscuration and is stored by the micro controller 40 in ROM 44 for later use in monitoring the sensitivity of the detector throughout its useful life. In the preferred embodiment, it is not actually the ambient signal that is retained in storage, but rather a digital representation of the difference between the alarm and ambient signals. In accordance with other embodiments, both the alarm and ambient output signals might be stored, or either one of the output signals and the difference between them. Still other embodiments might employ look-up tables, or the like, that would assign coordinate values representing the desired calibration factor.

After installation of the detector, and during its operation, the detector repeatedly samples the output from optical sensor 16 and compares the output to the stored value representing an alarm condition. If the sampled value exceeds the alarm threshold, the micro controller activates alarm 48 and energizes visible LED 32, either through its driver 50 as shown or, if preferred, through the alarm. In the preferred embodiment, the alarm is activated only after the threshold is exceeded by three successive iterations or LED pulses. This reduces the possibility of an alarm caused by transient conditions such as cigarette smoke or airborne dust.

Figure 3:
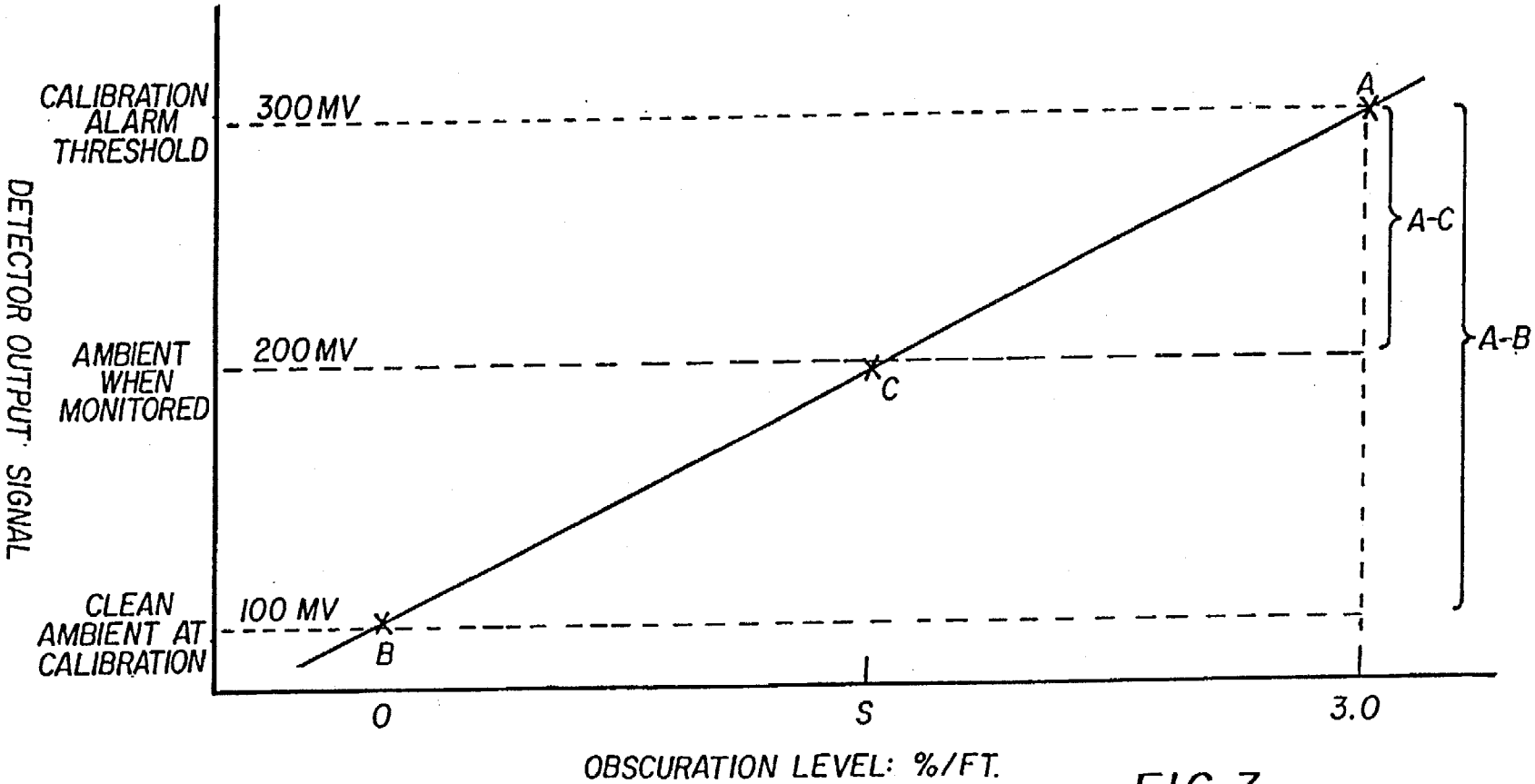
FIG. 3 is a graph depicting the values sampled for calibration prior to installation and corresponding values sampled during monitoring after installation.

Referring now to FIG. 3, immediately following calibration of the smoke detector, its sensitivity, measured as visible obscuration in percent per foot, is represented by the difference between points A and B, and is equal to the amount of obscuration in the sample used to calibrate the alarm threshold. Point A is at three percent per foot obscuration, which is represented by an output signal of 300 millivolts, for example. Point B is at zero obscuration relative to ambient, and is represented by an output signal of 100 millivolts, for example. In the preferred embodiment, of course, these voltages are stored as digital values.

After installation, dust and other reflective material may settle in the chamber, accumulating over time. This increases the background scatter and reduces the amount of smoke required to reach the alarm threshold, thereby increasing the sensitivity of the detector and its propensity to false alarm. The detector also may become less sensitive than the calibrated sensitivity due to blockage of the emitter or other malfunction. In this case, more than the calibrated amount of smoke is required to reach the alarm threshold. Point C on FIG. 3 represents a sample under clean-ambient conditions when the detector is monitored some time after installation. It shows that the sensitivity of the detector has increased since it was calibrated. The sensitivity is now the difference between points A and C. Smoke that increases obscuration by an amount represented by the distance between point S and the alarm threshold will initiate an alarm.

FIG. 3 represents a straight line approximation of a semi-logarithmic relationship between the detector output signal and its sensitivity. This approximation has been found satisfactory for the intended purpose over the ranges typically encountered in smoke detectors.

Figure 4:
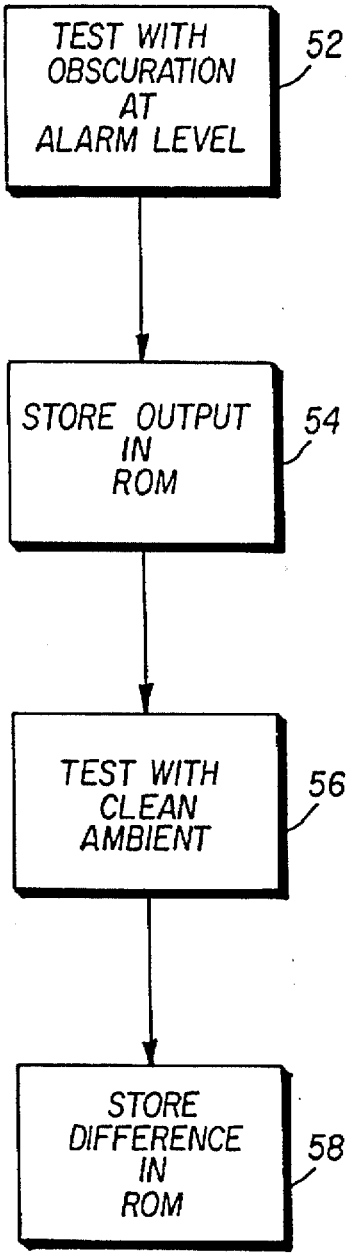
FIG. 4 is a flow diagram depicting the steps for taking calibration samples prior to installation.
Figure 5:
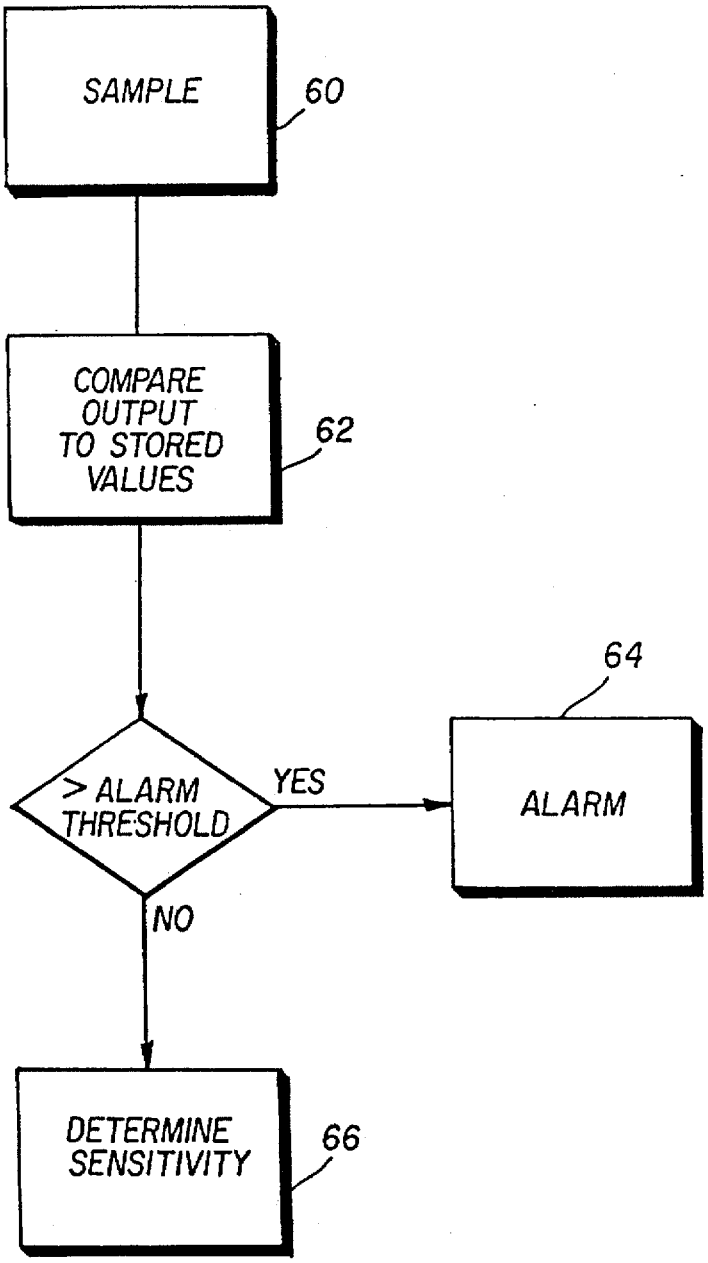
FIG. 5 is a flow diagram depicting the steps for monitoring and determining sensitivity after installation.

In accordance with this preferred embodiment, the information gained during the initial calibration of each detector is used to determine point S and the remaining sensitivity of the detector. Referring to FIGS. 4 and 5, each detector is tested prior to installation with a calibration sample representing an alarm condition, box 52, and the resulting output signal is stored for later use, box 54. The detector is tested under clean-ambient conditions at approximately the same time, box 56, and the resulting output again is stored for later use, box 58.

After installation, and during monitoring of the sensitivity of the detector, clean-ambient conditions are sampled, box 60, and compared to the values determined during calibration, box 62. If the monitored value exceeds the alarm threshold, the alarm is activated, box 64, as described above. If below the alarm threshold, the sensitivity of the detector is determined, box 66, and a representation of that sensitivity, preferably an analog voltage that can be sensed by a common voltmeter, is made available at contacts 68 (FIGS. 1 and 2).

The sensitivity determination is based on the relationships depicted in FIG. 3, and the realization, after extensive testing, that the change in sensitivity is approximately a straight line function compared to the change over time in output signal under clean-ambient conditions. Thus the sensitivity S can be determined from the ratio of the difference A–C over the difference A–B times the alarm threshold, which is three percent per foot obscuration in the example depicted. Thus the value of S is determined to be 1.5 percent obscuration per foot. An output signal representing the voltage ratio or the sensitivity is made available by micro controller 40 at contacts 68.

It should now be apparent that the invention provides a measure of detector sensitivity, not merely a pass-fail test. According to one feature of the invention, sensitivity is based on the electrical characteristics of each individual detector. According to another feature, the output representing sensitivity is accessible to an external probe such as a common voltmeter. Still another feature permits sensitivity testing while the detector continues to operate in a functioning alarm circuit. All of the above-mentioned features and advantages are available in a detector that can be installed easily in existing two and four-wire installations. Multiplexed central control is not required.

While the invention has been described with particular reference to a preferred embodiment, it will be understood by those skilled in the art that various changes may be made and equivalents may be substituted for elements of the preferred embodiment without departing from invention. It is accordingly intended that the claims shall cover all such modifications and applications as do not depart from the true spirit and scope of the invention.

What is claimed is:

1. A process for calibrating an individual smoke detector prior to installation, said process comprising:

testing the detector under a first condition to determine a first output characteristic of said first condition;

testing the detector under a second condition to determine a second output characteristic of said second condition;

storing in said individual detector representations from which said first and second outputs can be determined.

2. The process claimed in claim 1, wherein said representations from which said first and second outputs can be approximated are representations of: a) said first output; and, b) said second output.

3. The process claimed in claim 1, wherein said representations from which said first and second outputs can be approximated are representations of: a) one of said first and second outputs; and, b) the difference between said first and second outputs.

4. The process claimed in claim 1, wherein said representations from which said first and second outputs can be approximated include a look-up table.

5. A process for calibrating an individual smoke detector prior to installation for use in monitoring the sensitivity of the detector after installation, said process comprising:

testing the detector prior to installation under a first level representing an alarm condition, and sensing a first electrical output of the 4detector characteristic of said alarm level;

testing the detector prior to installation under a second level representing a non-alarm condition, and sensing a second electrical output of the detector characteristic of said non-alarm level;

storing in said detector prior to installation, and retaining in said detector after installation, electrical representations from which said first and second outputs can be substantially redetermined.

6. The process claimed in claim 5, wherein said representations from which said first and second electrical outputs can be substantially redetermined are representations of: a) said first output; and, b) said second output.

7. The process claimed in claim 5, wherein said representations from which said first and second electrical outputs can be substantially redetermined are representations of: a) one of said first and second outputs; and, b) the difference between said first and second outputs.

8. The process claimed in claim 5, wherein said representations from which said first and second electrical outputs can be substantially redetermined include a look-up table.

9. A process for calibrating a smoke detector prior to installation and monitoring the sensitivity of the detector after installation, said process comprising:

recording outputs of the detector, prior to installation of the detector, characteristic of a first condition and a second condition;

sensing outputs of the detector, during monitoring of the detector after installation, characteristic of said second condition;

providing a sensitivity signal for the detector dependent on the relationship between the first and second outputs prior to installation and the second output at the time of monitoring.

10. A process for calibrating and monitoring an individual smoke detector, comprising:

testing the detector for calibration prior to installation and determining from said testing a first output indicative of the difference between a clean-ambient condition and an alarm condition;

retaining with the detector a representation of said first output;

monitoring the detector for sensitivity of the detector subsequent to installation, and determining from said subsequent monitoring a second detector output indicative of the then difference between an ambient condition and an alarm condition;

providing a sensitivity signal dependent on the relationship between the first and second outputs.

11. A process for calibrating an optical smoke detector before installation and monitoring the detector after installation, comprising:

calibrating the detector before installation by:

recording a first output of the detector characteristic of an alarm condition;

recording a second output of the detector characteristic of a clean-ambient condition;

monitoring the detector after installation by:

sensing a third output of the detector characteristic of an ambient condition;

providing a calibration signal dependent substantially on the ratio of: a) the difference between the first and third outputs; and, b) the difference between the first and second outputs.

12. Calibration apparatus for an individual smoke detector including means for providing an output characteristic of the level of obscuration by smoke at the location of the detector, said apparatus comprising:

means storing in said detector first and second test signals representing detector outputs prior to installation, under alarm and ambient conditions, respectively;

means for sensing a detector output under ambient conditions during monitoring of the detector after installation;

means for determining a sensitivity signal based on a relationship between the sensed output during monitoring and the first and second test signals.

13. Apparatus according to claim 12, wherein said relationship is substantially the ratio of: a) the difference between the first and third outputs; and, b) the difference between the first and second outputs.

14. A smoke detector for monitoring the level of atmospheric obscuration in the vicinity of the detector, said detector comprising:

sampling means for producing electrical signals characteristic of the level of obscuration in the vicinity of the detector;

storage means for storing in said detector representations of electrical signals produced by said sampling means prior to installation of the detector, said storage means including stored representations of alarm and clean-ambient conditions;

comparing means for comparing electrical signals produced by said sampling means after installation with said representations of alarm and ambient conditions prior to installation, and for issuing a detector sensitivity signal based on said comparison.

15. A smoke detector including a dark chamber for receiving smoke from a fire, an emitter for directing illumination along a path extending into said chamber, and a sensor disposed out of said path for viewing said path and providing a signal indicative of the amount of illumination reflected from said path by particles such as smoke in said chamber, said smoke detector comprising:

means storing in said detector first and second test signals representing detector outputs, prior to installation, under alarm and ambient conditions, respectively;

means for sensing a detector output under ambient conditions during monitoring of the detector after installation;

means for determining a sensitivity signal based on a relationship between the sensed output during monitoring and the first and second test signals.

16. Apparatus according to claim 15, wherein said relationship is substantially the ratio of: a)the difference between the first and third outputs; and, b) the difference between the first and second outputs.

* * * * *